US005398883A

United States Patent [19]

Stauber

[11] Patent Number: 5,398,883

[45] Date of Patent: Mar. 21, 1995

[54] METHOD AND APPARATUS FOR THE INTERMEDIATE STORAGE AND/OR REARRANGEMENT OF PRINTER PRODUCTS IN SCALE FORMATION

[75] Inventor: Hans-Ulrich Stauber, Grüt, Switzerland

[73] Assignee: SFT AG Spontanfördertechnik, Weinfelden, Switzerland

[21] Appl. No.: 276,988

[22] Filed: Jul. 20, 1994

Related U.S. Application Data

[63] Continuation of Ser. No. 854,830, Mar. 20, 1992, abandoned.

[30] Foreign Application Priority Data

Mar. 22, 1991 [CH] Switzerland ..... 00888/91

[51] Int. Cl.[6] ..... B65H 29/00

[52] U.S. Cl. ..... 242/533.8; 242/528

[58] Field of Search ..... 242/58.6, 59, 79, 528, 242/533.1, 533.3, 533.8, 557, 558; 198/347.3, 468.6, 803.12; 414/783, 910, 911; 53/118, 430

[56] References Cited

U.S. PATENT DOCUMENTS

| | | | |
|---|---|---|---|
| 4,601,436 | 7/1986 | Honegger | 53/118 X |
| 4,703,901 | 11/1987 | Stauber | 242/79 X |
| 4,769,973 | 9/1988 | Reist | 53/118 X |
| 4,863,112 | 9/1989 | Summerauer et al. | 242/79 X |
| 4,866,910 | 9/1989 | Reist | 53/430 |
| 4,898,336 | 2/1990 | Reist | 242/59 |
| 4,925,120 | 5/1990 | Meier | 242/58.6 X |
| 4,928,899 | 5/1990 | Reist | 53/118 X |

FOREIGN PATENT DOCUMENTS

| | | |
|---|---|---|
| 0329602 | 8/1989 | European Pat. Off. . |
| 2170793 | 8/1986 | United Kingdom . |

*Primary Examiner*—Daniel P. Stodola
*Assistant Examiner*—John P. Darling
*Attorney, Agent, or Firm*—Walter C. Farley

[57] ABSTRACT

Printed products, which are obtained as a scale formation from a processing stage (10), are intermediately stored and rearranged in such a way that they can again be supplied for further processing to a processing stage (20) as a scale formation, which can have a different number of scale flows, different speeds and a different sequence of different printed products. The method takes place in three method zones. In the first method zone (1), which is connected to the processing stages (10 and 20), the scale flows (S) are wound onto roll cores (WK) or rolls (W) are unwound into scale flows (S). In the second method zone (2), the rolls (W) and cores (WK) are transported between the storage station and the winding station and storage units (horizontal roll pairs (WP) and core flanges (R)) are formed and dismantled. In the third method zone (3) the storage units (WP, R) are introduced to and removed from a store. In all the method zones handling of printed products and auxiliary storage means takes place solely constituted by the roll cores with strips or bands. An advantageous feature of the inventive method is that the apparatus used in the individual method zones are method zone-specific and not product or auxiliary storage material-specific.

4 Claims, 4 Drawing Sheets

FIG. 3a
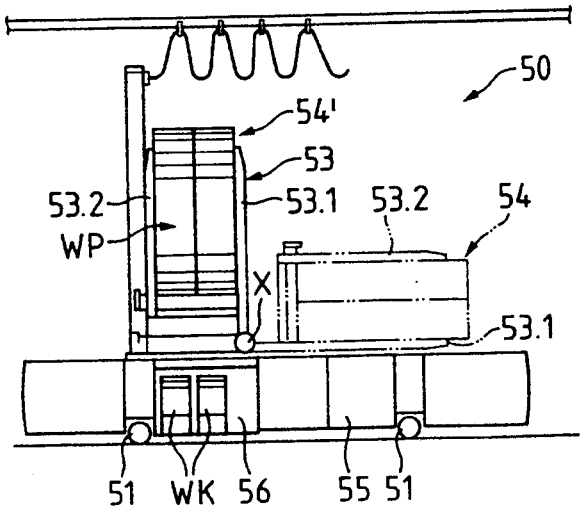
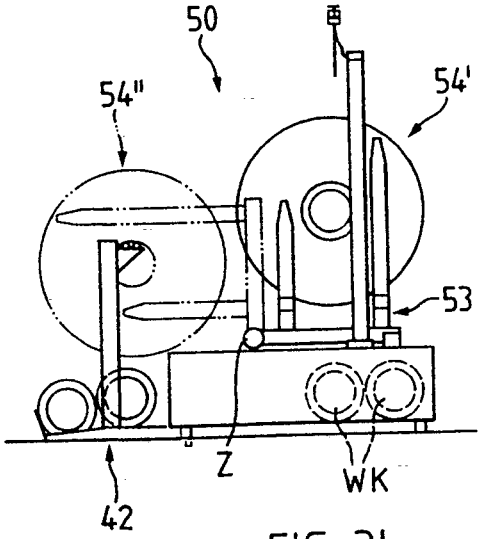
FIG. 3b
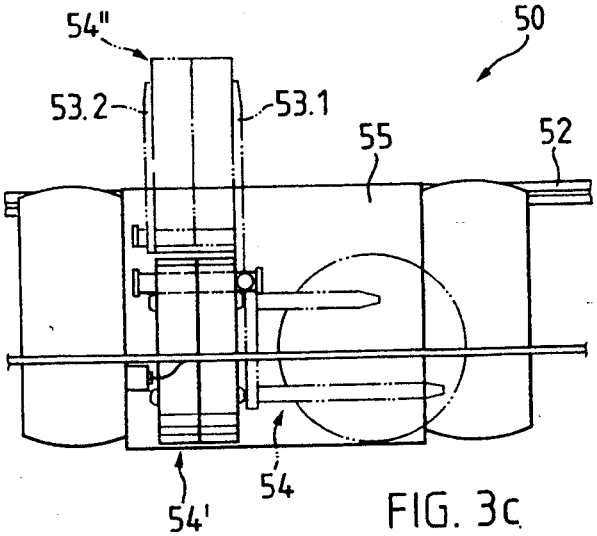
FIG. 3c

METHOD AND APPARATUS FOR THE INTERMEDIATE STORAGE AND/OR REARRANGEMENT OF PRINTER PRODUCTS IN SCALE FORMATION

This is a continuation of application Ser. No. 07/854,830, filed Mar. 20, 1992, now abandoned.

FIELD OF THE INVENTION

The invention is in the field of the further processing of printed products and relates to a method, apparatuses and installations according to the independent claims. The method and apparatuses are used for intermediately storing and/or rearranging printed products in scale formation between two processing stages, e.g. between the rotary machine or press and a following processing stage.

BACKGROUND OF THE INVENTION

Printed products in scale formation, which are e.g. continuously supplied by rotary machines and which are not immediately further processed and/or not in the sequence as obtained, must be intermediately stored and/or rearranged. This e.g. applies during the manufacture of telephone directories, in which a plurality of individual, different products from the rotary machine or machines are brought together and bound to form an end product. For this purpose the rotary machine products are in known manner wound in the form of the scale flow supplied and intermediately stored as a roll prior to further processing. According to another method for the intermediate storage of such products, they are collected and introduced by means of gripper-like tools into corresponding storage containers, which are e.g. transported on pallets.

It has been found that the known methods for the intermediate storage and/or rearrangement cannot be readily fully automated and that they are not of an optimum nature with regards efficiency and storage space requirements. This is due to the fact that the products are stored in a form, which cannot be automatically assembled and released, or involves considerable expenditure in doing so. In addition, a considerable amount of storage space is required for the auxiliary means, such as pallets and the like required and the closed cycle of said auxiliary means comprises a method part completely separate from the passage of the products and which is not generally automated.

SUMMARY OF THE INVENTION

The problem of the invention is to provide a method for the intermediate storage and/or rearrangement of printed products in scale formation, as well as apparatuses and installations for performing the inventive method, in such a way that compared with the prior art methods improvements can be achieved with respect to the degree of automation attainable, with respect to the utilization of the storage space and transportation capacity and with respect to the adaptability to the methods and apparatuses of the upstream and downstream processing stages.

The main features of the inventive method are that it requires, by volume, very little storage auxiliary material which, after use, can be returned into the method (no consumed material) and that this return is adapted to the printed product intermediate storage and rearrangement process so as to be fully integratable therein.

Thus, the method leads to a working process with an adapted and integrated return of the auxiliary material.

BRIEF DESCRIPTION OF THE DRAWINGS

The inventive method and apparatus and installations thereof are described in greater detail hereinafter with reference to the following drawings. Control systems for the method of the invention and, in particular, for a store management are known so that part of the method need not be described in detail. In the drawings:

FIGS. 3*a*, 3*b* and 3*c* are side, end and top plan views, respectively, of an apparatus in accordance with the invention for performing the functions of a second method zone wherein storage units are produced and dismantled;

DESCRIPTION OF THE PREFERRED EMBODIMENTS

The inventive method is used between two processing stages 10 and 20, the printed products supplied continuously in scale formation from the processing stage 10 being processed to the continuous scale formation of printed products required for the processing stage 20. The scale formation entering the inventive method can defer from that passing out through the number of scale flows and/or their speeds, the product capacities at the inlet and the outlet at a given time being the seine or different. The two scale formations can also differ through the sequence with which the different types of printed products follow one another.

The inventive method has a random number of identical inlets and outlets for the scale flows. Each of the inlets and outlets is linked with one of the processing stages 10 or 20 and only as a result of this link acquire a definitive function as inlet or outlet. Thus, the method can be adapted to very different pairs of processing stages 10 and 20. It is also conceivable to have a processing stage 10 supplying more than one scale flow and a processing stage 20 processing more than one scale flow.

For the intermediate storage and rearrangement of the scale formation entering the inventive method, the formation is subdivided into storage units. These storage units are introduced into and removed from a store, whose control is determined by the processing stages 10 and 20 or their product outlet/inlet.

In order that the management of the store fulfils the requirements defined hereinbefore, the store management apparatuses and the storage units of the printed products are correspondingly matched to one another. The storage units can be transported and stored with minimum auxiliary storage material. This saves transportation capacity and storage space. However, the storage units are still as large as possible, which cuts down on the transportation path.

As a further improvement the auxiliary storage material cycle taking place within the inventive method is completely integrated into the printed product store management. This is made possible by the fact that the auxiliary storage material is also stored for its return to the storage units. The shape of the auxiliary storage material corresponds to the printed product storage units and the two types of storage units can therefore be stored at interchangeable storage locations.

The integration of the auxiliary storage material cycle into the printed product storage is realized in that the inventive apparatuses for performing the method are so designed that they can handle printed products and auxiliary storage material in the same way and that the auxiliary storage material cycle is subject to the same control as the printed product storage.

Figure 1:
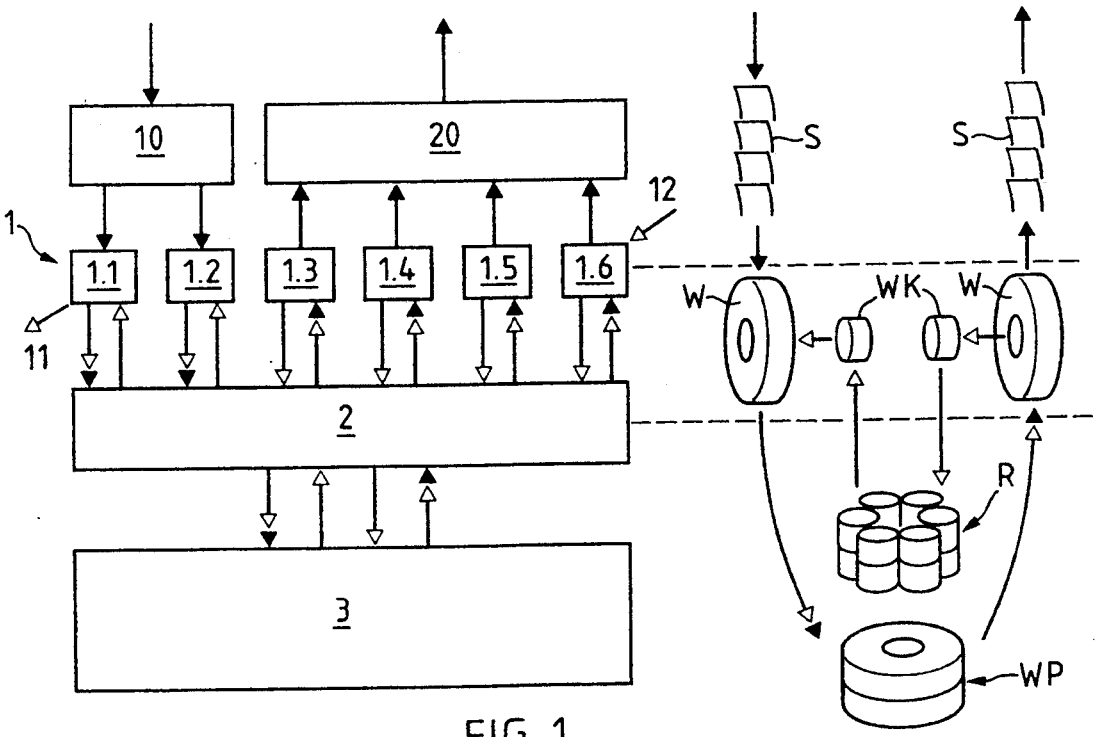
FIG. 1 is a diagram illustrating the method of the invention.

FIG. 1 shows the inventive method as a diagram and is used for illustrating the already described main features of the method. The left-hand part of the diagram shows the method in a purely abstract form, whereas the right-hand part shows the different formations of printed products and auxiliary material. The method is subdivided into three zones, in which different method steps are performed and which are traversed by the printed products and the auxiliary material in two directions in both cases. The direction in which the printed products pass through the method is indicated with solid arrows, that of the auxiliary storage material by arrows which are not filled in and the direction of the storage formations of the printed products, which include auxiliary material and printed products, are indicated by double arrows. The representation of the passage of the printed products and auxiliary material through the inventive method with said separate arrows is misleading in that they do not take place separately but integrated into one another and it is this integrated nature which constitutes an essential feature of the inventive method. The description will make detailed reference thereto.

The inventive method has in a first method zone 1 a number (e.g. 6) inlets/outlets for printed products in scale flow formation, whose function is determined by the link thereof with a scale flow-supplying processing stage 10 or a scale flow-processing stage 20. The drawing shows two inlets 1.1/2 and four outlets 1.3/4/5/6. In the inlets/outlets 1.1/2 functioning as inlets the scale flows S are subdivided into preliminary storage units, e.g. are wound up to form rolls W and for this purpose winding or roll cores WK (auxiliary storage material) are required. In the inlets/outlets 1.3/4/5/6 functioning as outlets the preliminary storage units are broken up, e.g. in that the rolls W are unwound to form scale flows S, giving the winding or roll cores WK (auxiliary storage material).

It is conceivable for the rolls W and cores WK to be introduced directly from the first method zone (inlet zone) 1. However, it is more advantageous if a second method zone 2 is positioned upstream between the inlet zone 1 and the third method zone 3 constituting the actual store and in it are produced the storage units for the printed products and for the auxiliary storage material. These storage units are e.g. horizontal roll pairs WP as storage units for printed products and loose core flanges are as storage units for the auxiliary storage material, which in both cases are essentially a cylinder having the same diameter and height. The storage units comprising printed products and cores (roll pairs) or only cores (flanges) are interchangeably introduced and removed with respect to the third method zone 3.

The apparatuses for handling printed products and auxiliary storage material used in the first, second and third method zones are equipped in such a way that they can handle both rolls or roll pairs and also cores or core flanges and that they can perform the manipulations necessary for the corresponding method zone in both directions, i.e. inlet-outlet and outlet-inlet. This means that for the method example with rolls as the preliminary storage units and horizontal roll pairs as storage units, that the winding stations used in the inlets/outlets are set up for winding on and off, that the apparatuses used in the second method zone can produce and dismantle horizontal roll pairs and core flanges and that the storage means used in the third method zone 3 handle horizontal roll pairs and core flanges and can transport in all the necessary directions.

The processing stage 10 can e.g. be a rotary press or presses, which supplies folded printed sheets e.g. in the form of two scale flows. The processing stage 20 can e.g. be a collecting device, an inserting system or some other processing system or systems, in which the sheets enter e.g. as four scale flows and which e.g. collects in each case four such sheets in a random order and supplies then in groups of four to further processing stages. For the manufacture of telephone directories it is e.g. conceivable for production to take place from two rotary presses, which by means of an inventive intermediate storage and rearrangement method supplies up to 30 or more collecting inlets with parallel scale flows.

The scale flow-supplying process stage 10 determines the number of scale flows, their speed and the time sequence of different products in said scale flows. The processing stage 20 processing the scale flows determines the number of simultaneously further processed scale flows, the processing speed and the time sequence with which the different products are processed. The inventive method places no limits on the two processing stages 10 and 20 with regards to the number of scale flows supplied and removed. The inventive method also makes no limitations on the scale flow speeds, the difference between the supply and removal and the time changes, but such limitations are placed by the apparatuses performing the method.

The method according to the invention will in most cases receive the product according to a production sequence (time order of different, succeeding products) and will supply same in a further processing sequence differing from the production sequence (time order of further processing of different products), i.e. it rearranges the products but the only rearrangements which are possible are those relating to entire storage units. In other words only one printed product type is to be stored on one roll pair or at least on one roll.

From the processing stage 10 at least one scale flow passes into an inlet 1.1 constructed as a winding station and in which the scale flow is wound with the aid of a cord or strip onto an e.g. hollow cylindrical roll core WK. This leads to the formation of a roll W, which hangs with a horizontal rotation axis in the winding station. Corresponding winding stations are e.g. described in U.S. Pat. Nos. 4,601,436, 4,769,973 and 4,898,336 of the same Applicant. For the presently described method, it is in particular appropriate to have winding stations as described in Swiss patent applications 791/90 and 3128/90 of the same Applicant, which are here assumed as known.

In addition, in the method zone 1 use is made of roll changers, which remove the full rolls from the winding stations and install empty roll cores. An exemplified embodiment of such an apparatus will be described in conjunction with FIG. 2.

The roll produced in the winding station is in a second method zone 2 rotated from its winding position (horizontal rotation axis) into its storage position (vertical rotation axis) and transported as a roll pair (storage unit) into a buffer station. The apparatus used in this second method zone will be described in conjunction with FIG. 3.

In the third method zone 3, the roll pair is transported from the buffer station to the effective intermediate store and is introduced into the latter. The diameters of the rolls and the roll technology are such that the rolls can be placed on one another in stacks of up to ten roll pairs without using further aids, such as frames or pallets, the stacks standing on the floor of the store. The apparatus used for introduction purposes is designed in such a way that the roll pairs can be transported without further aids, such as e.g. pallets. These two measures makes it possible to increase the storage space utilization by up to 50% compared with known storage methods. Due to the fact that the storage space or area requires a minimum of fixed structures, it can entirely or partly fulfil other functions at any time. An apparatus for use in the third method zone 3 will be described in conjunction with FIG. 4.

When required by the processing stage 20, the roll pairs are removed from the store again, i.e. are transported from the storage location to the buffer station and this operation is performed with the same apparatus as the introduction into the store.

The roll pair is fetched from the buffer station and transported to the winding station, whilst the storage unit is dismantled, i.e. the two rolls are separated and rotated back into the winding station with a horizontal rotation axis (second method zone 2). The apparatus used there and described in conjunction with FIG. 3 is designed in such a way that it can be used for both passage directions through the method zone 2.

In an outlet winding station (e.g. 1.3), which corresponds to an inlet winding station, but which is traversed by the printed products in the opposite direction, the roll is unwound to form a scale flow. The scale flow or several such flows are passed into the processing stage 20.

The empty roll cores, which are obtained on unwinding (method zone 1) and required again on winding, pass through the inventive method in the direction opposite to the product. They are transported in the second method zone 2 to a buffer station and combined into a storage unit. The storage unit comprises a flange R containing 18 cores, with three placed upon one another in each case in loose manner and without requiring further aids. For a stable stacking of the cores on one another, it is advantageous for e.g. the two narrow circular surfaces of the cores to be constructed as two steps, so that the lower edge of one core can engage in the upper edge of the other. The transportation of the cores from the winding station to the buffer station is carried out with the aid of the same apparatus as used for roll transportation (cf. FIG. 3 and corresponding description). It is also conceivable to construct this apparatus in such a way that it can also produce the core flanges. However, the flanges can also be produced by a correspondingly controlled, special lifting appliance or by hand.

The space requirement of a roll core flange is essentially the same as that of a horizontal roll pair, i.e. it can take the place of such a pair and vice versa. It is e.g. conceivable for the same space to be occupied either by a stack of 18 rolls (9 roll pairs) or by the corresponding 18 cores in the form of a flange. The apparatus for handling the storage units must be designed in such a way that it can introduce and remove the flanges from the store (cf. FIG. 4 and the corresponding description).

If necessary the flange is removed from the store again (method zone 3) and brought into a buffer station. The individual roll core is released from the storage unit representing the flange (method zone 2), transported to an inlet winding station (e.g. 1.1) and used there, so that a new roll can be wound onto it (method zone 1). The same apparatuses are used in both method zones 2 and 1 for handling beth the empty cores and for handling the printed product rolls.

If the method stages 10 and 20 and the interposed, inventive method are controlled by a central intelligence, a closed product section is obtained. It is difficult to incorporate into the fully automatic intermediate storage rolls which are much smaller than the normal rolls. Such small rolls can e.g. be obtained on converting process stage 10 to a different product or in the case of production or winding faults. It is advantageous to remove such small rolls from the intermediate storage cycle as from the winding station (arrow 11) and to supply them for further processing by using other means (arrow 12).

Thus, in summarizing, the inventive method takes place in three method zones:

- in the first method zone 1, which follows onto the processing stages 10 and 20 and in which the scale flows are wound onto roll cores or rolls are unwound to form scale flows,
- in the second method zone 2, in which rolls are cores are transported between the buffer station and winding station and in which storage units (horizontal roll pairs and flanges) are produced and disassembled,
- and in the third method zone 3, in which storage unit introduction and removal take place.

In all the method zones printed products and auxiliary storage material, which merely comprises roll cores with strips, are handled. An advantageous feature of the inventive method is that the apparatuses used in the individual method zones are method zone-specific and not specific to the product or auxiliary storage material. As a result the necessary number and/or the necessary transportation path of the corresponding apparatuses can be limited to a minimum, the control is simplified and the capacity increased.

Figure 2A:
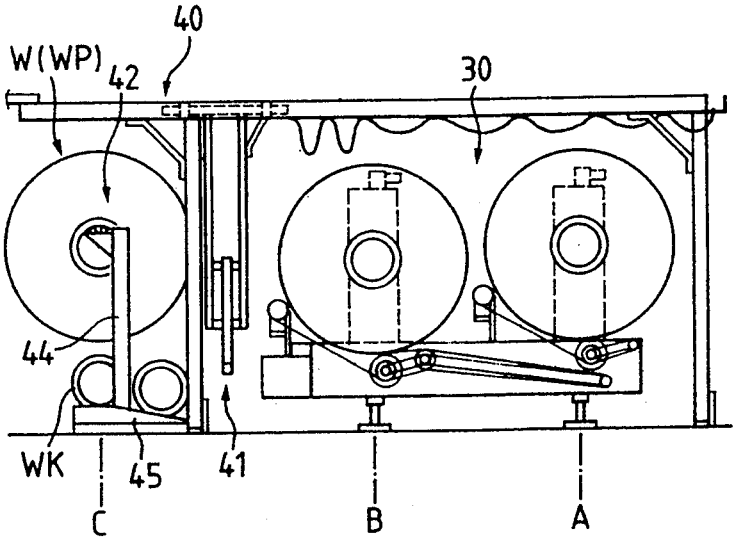
FIG. 2*a* and 2*b* are side and end elevations, respectively, of an embodiment of an apparatus in accordance with the invention for performing the functions of a first method zone 1 in which rolls are wound up and taken off.
Figure 2B:
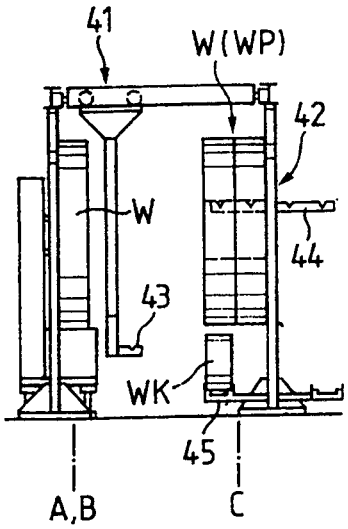

FIGS. 2*a* and *b* show a roll changer, i.e. an exemplified embodiment of the apparatus placing the rolls and empty roll cores on the winding station and removes same therefrom, whilst combining the rolls into pairs. The roll changer 40 together with the winding station 30 is shown in a view in FIG. 2*a* with the viewing direction parallel to the roll axes and in FIG. 2*b* with the viewing direction at right angles to said axes.

The winding station 30 is designed in such a way that it always processes (winds on or off) a roll, whilst a second roll is being changed. The two rolls of the winding station are successively arranged in the direction of the entering or exiting scale flow. The roll changer 40 essentially comprises a transporting means and a storage means, in the present embodiment constituted by a movable lifting appliance 41 and a frame 42. The movable lifting appliance 41, which can be rotated by 180° is horizontally movable in such a way that it can reach the roll positions on the winding station (A and B) and the roll position on the frame (C). The lifting appliance is equipped with at least one lifter or jack 43, or in each case one of the latter which can be pivoted away to the left and right, which is designed in such a way that it can grip a roll core and raise the same. The lifter 43 is vertically movable between the maximum position, which can be assumed by an empty or full core on the winding station 30 or the frame 42 and the corresponding lowest position. The frame 42 is equipped with a hanging or suspension device 44 for at least one, in the represented embodiment, two rolls and a tiltable mounting support 45 for empty roll cores. The mounting support 45 is tiltable, so that the empty cores can be actively loaded onto a further transporting means.

If the winding station has a winding on function (product inlet in the inventive method), the lifting device 41 with the lifter 43 fetches full rolls from the winding station and hangs them on the hanging device 44 of the frame 42. It also fetches empty roll cores from the mounting support 45 and places them on the winding station. When the winding station is performing an unwinding function (product outlet in the inventive method), the roll changer function is reversed. It is advantageous to design the roll changer in such a way that it can service two parallel winding stations by moving between then. The roll changer is subject to a control, which is coordinated with the winding station control.

FIGS. 3*a* to *c* show a shuttle vehicle 50, namely an embodiment of the apparatus which takes the winding pairs from or supplies them to the frame 42, changes the position thereof and transports the empty roll cores and rolls between the frame 42 and the buffer station. FIG. 3*a* shows the shuttle vehicle as a view in a direction at right angles to the axes of the roll to be taken up by the vehicle and FIG. 3*b* in a direction parallel to said axes and FIG. 3*c* from above. Such a shuttle vehicle fetches and brings rolls, in the represented embodiment roll pairs, and empty roll cores from the frames 42 and transports then to a buffer station. The essential feature of the shuttle vehicle is that it is equipped with means with the aid of which it can rotate the rolls from a vertical into a horizontal position and vice versa. The shuttle vehicle advantageously moves on rails between the particular frame 42 which it is servicing and the buffer station. As a function of the capacity and local arrangement of a complete installation for performing the inventive method, such a shuttle vehicle will service all the winding stations functioning as inlet and outlet stations, or for the inlets on the one hand and the outlets on the other one or more such vehicles are used (cf. also description of FIG. 5). Similar apparatuses are describes in Swiss patent applications 205/86, 1730/86 and 3998/87 and in Swiss patent 875868.

As has already been mentioned in conjunction with the method, the individual functions of the method zone 2, the transportation of rolls and cores and the formation of the two storage units (horizontal roll pair and flange) can be distributed over different apparatuses. Thus, the represented exemplified variant shows a shuttle vehicle, which cannot produce or dismantle core flanges. At the storage station the cores are automatically loaded from the shuttle vehicle, but must be stacked by a correspondingly controlled lifting appliance or by hand in order to form such flanges and conversely the cores must be individually loaded into the vehicle by a corresponding lifting appliance or hand from the flanges.

The shuttle vehicle comprises a chassis 55, travelling with wheels 51 on rails 52. The chassis is positioned asymmetrically on the wheels in such a way that the vehicle can be loaded very asymmetrically at right angles to the travel direction. A double tiltable roll clamp 53 is fitted to the chassis. The clamp is tiltable about the axis X and brings a horizontal roll pair 54 into a vertical position 54'. The clamp is also tiltable about an axis Z, the vertical roll pair 54' being brought into an unloading position 54'', which in its height and perpendicular to the shuttle vehicle travel direction corresponds to the position of the frame 42. The described function of the movement of the roll clamp relates to its function in conjunction with an unwinding winding station, the function being reversed for a winding up station. The clamp 53 comprises two parallel, reciprocally movable clamp arms 53.1 and 53.2, which in turn can in each case comprise two fingers. The two clamp arms 53.1 and 53.2 of the clamp 53 are so movable against one another by a corresponding drive, that they can secure a roll pair with a sufficient force to be able to reliably transport the same freely and without additional aids. The chassis 55 also has a transportation area 56 for cores WK. The transportation area 56 has means with the aid of which cores can be removed therefrom.

Figure 4A:
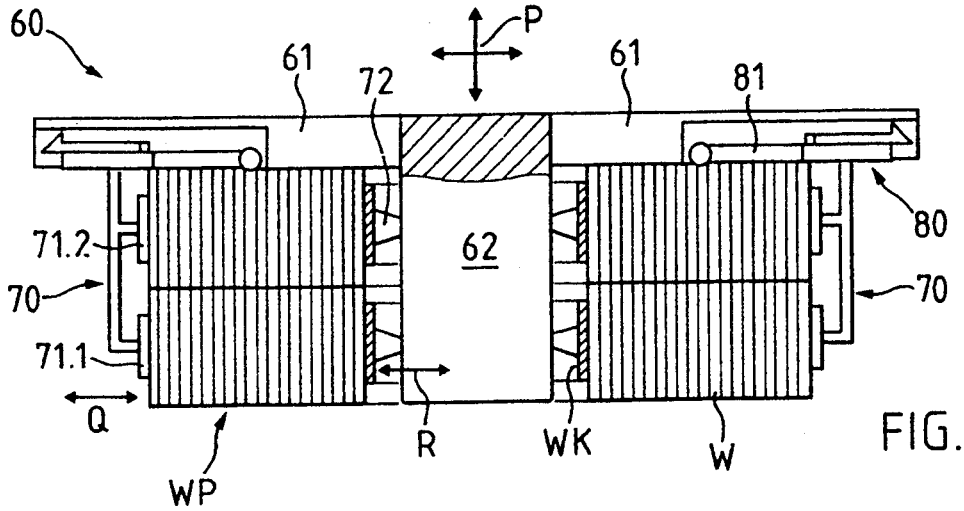
FIGS. 4*a*, 4*b* and 4*c* are side sectional views and a top plan view of an apparatus in accordance with the invention for performing the functions of a third method zone in which the storage units are introduced and removed.
Figure 4B:
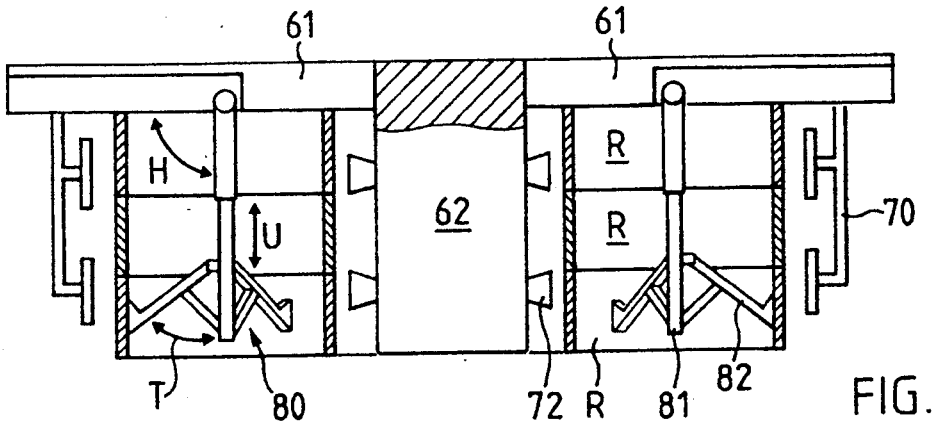
Figure 4C:
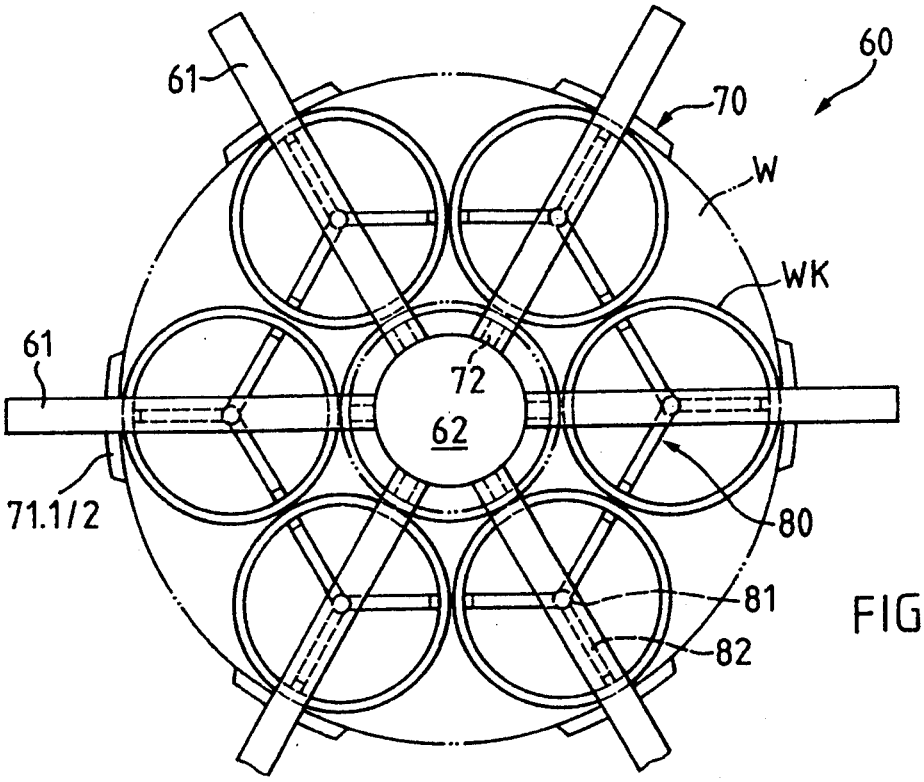

FIGS. 4*a* to *c* show an exemplified embodiment of a gripper 60, which is introduced into the third method zone and which enable storage units of printed products (horizontal roll pairs) and roll cores (flanges) to be gripped and transported. The represented gripper can also grip and secure individual rolls. The drawings show the gripper in section (section planes parallel to the rotation axis of a gripped roll), with a gripped roll pair (FIG. 4*a*), with a gripped core flange (FIG. 4*b*) and in plan view (FIG. 4*c*). For its function in the method zone 3, the gripper 60 is fixed to a conventional storage means and is consequently movable in all directions (arrow cross P). Said storage means can e.g. be a vehicle running on rails, which services the store through a gorge, or can be a surface crane, which services the store flat from above. The capacity of the entire installation, the speed of the storage means and the surface area of the store determine how many storage means with grippers have to be used.

The gripper 60 advantageously comprises an e.g. radial gripper body 61 with a central part 62. In operation the gripper body 61 assumes a horizontal position and has downwardly projecting outer gripping means 70 for gripping a roll pair WP and inner gripper means 80 for gripping a core flange R.

The outer gripping means 70 have double jaws 71.1/2, which can be radially moved (arrow Q) with the aid of a corresponding, not shown drive and with which a radial force can be exerted on a roll pair WP or a single roll W, which is sufficient to secure the roll. The function of the double jaws 71.1/2 can be assisted by further retaining means 72, which are fitted to the central part 62 and which can be radially moved within the roll cores and can exert a radial force on said cores of the individual roll pair rolls. For this purpose the retaining means 72 are connected to corresponding elastic means or a corresponding, not shown drive. For gripping and securing a roll pair the outer gripping means 70 are moved into their outermost position and the additional retaining means 72 into their innermost position. The gripper is then moved over the roll pair and lowered until the winding body 61 rests on the roll pair WP or the central part 62 on the substrate (for gripping only one roll). The outer gripping means 70 are then moved against the roll outer surfaces and the additional retaining means 72 against the roll core WK in order to secure the rolls.

The inner gripping means 80 are arranged in a circle around the central part 62, said circle corresponding to that on which the centres of the Cores of a core flange are located. The inner gripping means 80 are used for gripping and securing the flanges R. If the gripper is occupied with a roll pair, the inner gripping means 80 are swung open (FIG. 4*a*). For this swinging movement (arrow H), the inner gripping means 80 are connected to a corresponding, not shown drive. The inner gripping means 80 essentially comprise length-adjustable (arrow U) arms 81 and spreading means 82 arranged perpendicular to the main plane of the gripper body 61 and which are adjustable radially to the arms (arrow T) and which can exert from the inside a force against a roll core. The arms 81 and spreading means 82 are connected to not shown drives for the indicated movements.

For gripping a core flange the inner gripping means 80 are extended (H) , the gripper 60 is moved over the flange and lowered onto it. The arms 81 are extended to their maximum length (U), if the flange comprises three superimposed cores, or into a corresponding shorter position for flanges where there are only one or two superimposed cores. The spreading means are extended (T) and in this way secure the flange.

Figure 5:
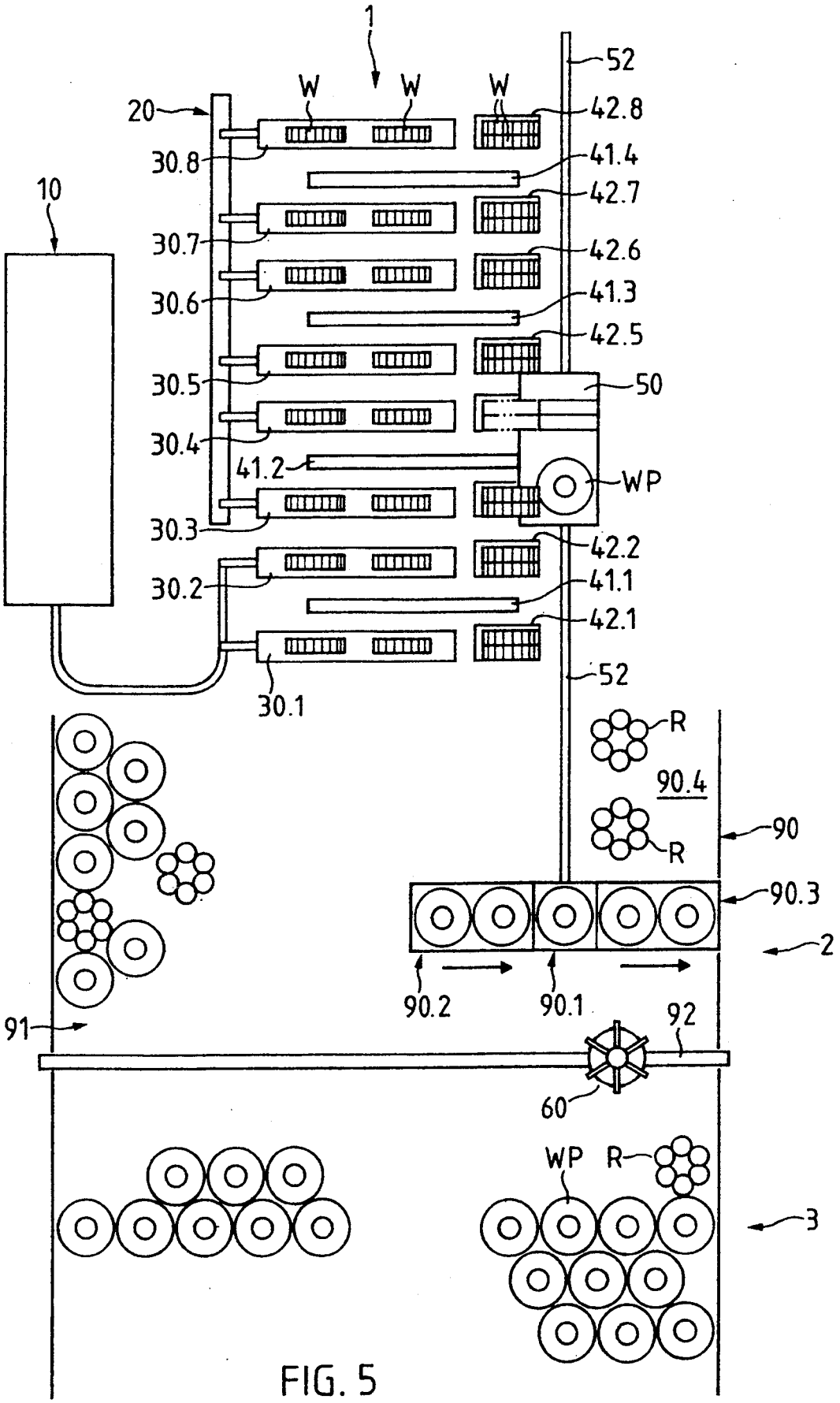
FIG. 5 is a schematic view of one example of an installation for performing the method of the invention using apparatus according to the invention.

FIG. 5 shows an exemplified installation for performing the inventive method using inventive apparatuses. It is a small installation, which can be extended at random. It is possible to see a rotary press, which represents the processing stage 10, as well as a system for bringing together the different printed products, which represents the processing stage 20. The rotary press e.g. supplies two scale flows, which are wound up by two winding stations 30.1 and 30.2, whilst the system for bringing together the printed product is supplied by e.g. six unwinding stations 30.3 to 30.8. Between in each case two winding stations is provided a roll changer with in each case one transporting means 41.1 to 41.4, which services two storage means (frames) 42.1/2 to 42.7/8. The method zone 1 constitutes the entirety of the winding stations and roll chargers.

Parallel to the line of the roll changer storage means 42.1 to 42.8 passes the path 52 of the shuttle vehicle 50, which terminates at one end thereof at the buffer station 90. If the entire installation was only operated with one shuttle vehicle, like that in the drawing, the buffer station would have to be in three parts. It has a transition point 90.1, which is constructed in such a way that the shuttle vehicle can take from and supply to it roll pairs. The buffer station also has a supply buffer 90.2 and a removal buffer 90.3. From the supply buffer 90.2, which can e.g. be in the form of a conveyor belt, roll pairs are supplied to a take-up point 90.1, whilst the removal buffer 90.3 takes up roll pairs from the take-up point 90.1. The buffer station also has a point 90.4, which produces and dismantles the roll core flanges R.

The actual store, represented by the method zone 3, is an area 91, which is serviced by at least one storage means 92 with a gripper 60. The storage means 92 is designed in such a way that, besides the entire storage area, it can also reach the supply buffer 90.2, the removal buffer 90.3 and the flange formation point 90.4.

For larger installations it is advantageous to arrange the store between the scale flow-supplying processing stage 10 and the scale flow-processing stage 20, so that the roll pairs pass through the store between an inlet and an outlet. The store inlet and outlet are then in each case provided with a buffer station and for the store inlet (as from the processing stage 10) and the store outlet (to the processing stage 20) is in each case used one shuttle vehicle, which then only transports the roll pairs in one direction. The complete installation is controlled by a superior intelligence, which coordinates the storage activities with the work of the processing stages 10 and 20.

I claim:

1. An apparatus for use in a method for the intermediate storage and rearrangement of printed products in scale formation between processing stations comprising the steps of conveying a stream of products in scale formation from a first processing station, providing empty roll cores as empty storage units, winding products from the stream of products onto roll cores to produce printed product storage units for intermediate storage, delivering roll cores having products wound thereon to a second processing station, unwinding and delivering to the second processing station a stream of the products in scale formation, repeating the foregoing steps with predetermined sequences and a cycle of empty and full roll cores as empty and printed product storage units whereby the steps can be performed under fully automatic control, the apparatus including at least two winding stations (30) with roll changers (40), means for handling single printed product rolls and single cores;

means for forming storage units each having a plurality of printed product rolls by turning at least one printed product roll through an angle of 90° until a central rotation axis thereof is in a substantially vertical plane;

and at least one shuttle vehicle (50) for handling and transporting rolls and roll cores between roll changers and a buffer station and moving said rolls into a horizontal position, said shuttle vehicle having a storage area (91), and at least one storage device serving said storage area, said at least one device having a gripper (60) for gripping and transporting at least one roll having the central axis thereof in a substantially vertical plane and a storage unit of empty roll cores comprising a rosette of roll cores including at least three juxtaposed empty roll cores having parallel central axes uniformly spaced from a central axis of the rosette.

2. A method for the intermediate storage and rearrangement of printed products between first and second processing stations wherein the printed products are output from the first processing station in at least one first scale flow and are provided to the second processing station in at least one second scale flow, the method comprising the steps of providing winding cores on which printed products can be wound for storage, winding selected segments of printed products from the at least one first scale flow on winding cores to form printed product storage rolls, forming a plurality of storage rolls into roll storage units for storage each storage unit having at least one roll with a central axis maintained in a vertical plane and transporting the units to a storage zone along a predetermined path, combining a plurality of empty winding cores into core storage units, each storage unit having at least three empty winding cores juxtaposed to form a rosette, and transporting the core storage units to the same storage zone along the predetermined path, the roll storage units and core storage units being combined in similar forms so that they can be manipulated interchangeably in a high-density storage area, selectively separating core storage units into individual cores for use;

selectively retrieving printed product roll storage units from the storage zone and separating the units into individual storage rolls, unwinding printed products from selected printed product storage rolls to form the second scale flow with printed products taken from the rolls, providing means for handling and transporting core storage units and roll storage units between an input/output zone and the storage zone, and matching the means for transporting and handling to the roll storage units and the core storage units so that the same means handles all storage units and transports them along the same predetermined paths.

3. A method according to claim 2 wherein the input-/output zone includes a plurality of inlets and outlets through which a plurality of scale flows pass in and out of the input/output zone, the functions of the inlets and outlets being determined by their connections to the first and second processing stations.

4. A method according to claim 2 wherein combining printed product storage rolls into roll storage units includes stacking a pair of printed product rolls (W) with their rotation axes vertical and aligned with each other and the step of combining empty roll cores into core storage units includes forming sets of three loosely superimposed roll cores in groups of six cylindrical sets.

* * * * *